US007101292B2

(12) United States Patent
Ohama et al.

(10) Patent No.: US 7,101,292 B2
(45) Date of Patent: Sep. 5, 2006

(54) MULTI-PIECE SOLID GOLF BALL

(75) Inventors: Keiji Ohama, Kobe (JP); Seiichiro Endo, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/616,968

(22) Filed: Jul. 11, 2003

(65) Prior Publication Data

US 2004/0009831 A1 Jan. 15, 2004

(30) Foreign Application Priority Data

Jul. 12, 2002 (JP) ..... 2002-204234

(51) Int. Cl.
*A63B 37/06* (2006.01)

(52) U.S. Cl. ..... 473/374

(58) Field of Classification Search ..... 473/376, 473/373, 374, 367, 368
See application file for complete search history.

(56) References Cited

U.S. PATENT DOCUMENTS

| | | | | |
|---|---|---|---|---|
| 5,553,852 | A | 9/1996 | Higuchi et al. | |
| 5,782,707 | A | 7/1998 | Yamagishi et al. | |
| 6,315,682 | B1 | 11/2001 | Iwami et al. | |
| 6,390,935 | B1 | 5/2002 | Sugimoto | |
| 6,390,936 | B1 * | 5/2002 | Sugimoto | 473/374 |
| 2003/0064828 | A1 * | 4/2003 | Kato | 473/374 |

FOREIGN PATENT DOCUMENTS

| | | | |
|---|---|---|---|
| JP | 7-24085 | A | 1/1995 |
| JP | 9-239068 | A | 9/1997 |
| JP | 2000-107327 | A | 4/2000 |
| JP | 2000-271249 | A | 10/2000 |
| JP | 2000-317015 | A | 11/2000 |

* cited by examiner

*Primary Examiner*—Raeann Gorden
(74) *Attorney, Agent, or Firm*—Birch, Stewart, Kolasch and Birch, LLP

(57) ABSTRACT

The present invention provides a multi-piece solid golf ball having very good shot feel, excellent rebound characteristics and excellent flight performance. The present invention relates to a multi-piece solid golf ball comprising a core consisting of a center and an intermediate layer formed on the center, and at least one layer of a cover covering the core, wherein the intermediate layer has a thickness of 0.3 to 2.5 mm and a hardness in Shore D hardness of 50 to 75, the hardness of the intermediate layer is higher than a surface hardness in Shore D hardness of the center and a hardness in Shore D hardness of the outermost layer of the cover, and the flexural modulus of the intermediate layer is lower than that of the outermost layer of the cover.

13 Claims, 3 Drawing Sheets

MULTI-PIECE SOLID GOLF BALL

FIELD OF THE INVENTION

The present invention relates to a multi-piece solid golf ball. More particularly, it relates to a multi-piece solid golf ball having very good shot feel, excellent rebound characteristics and excellent flight performance.

BACKGROUND OF THE INVENTION

In golf balls commercially selling, there are solid golf balls such as two-piece golf ball, three-piece golf ball and the like, and thread wound golf balls. Recently, the solid golf balls, of which flight distance can be improved while maintaining soft and good shot feel at the time of hitting as good as the conventional thread wound golf ball, generally occupy the greater part of the golf ball market. Multi-piece golf balls represented by three-piece golf ball have good shot feel while maintaining excellent flight performance, because they can vary hardness distribution, when compared with the two-piece golf ball (Japanese Patent Kokai Publication Nos. 24085/1995, 239068/1997, 271249/2000, 107327/2000, 317015/2000 and the like).

In Japanese Patent Kokai Publication No. 24085/1995, a three-piece solid golf ball comprising a center core, an intermediate layer and a cover is disclosed. The center core has a diameter of at least 29 mm and specific gravity of less than 1.4, the intermediate layer has a thickness of at least 1 mm, specific gravity of less than 1.2 and JIS-C hardness of at least 85, the cover has a thickness of 1 to 3 mm, and the specific gravity of the intermediate layer is lower than that of the center core.

In Japanese Patent Kokai Publication No. 239068/1997, a three-piece solid golf ball comprising a core, an intermediate layer and a cover is disclosed. The core has a center hardness in JIS-C hardness of not more than 75 and a surface hardness in JIS-C hardness of not more than 85, the surface hardness is higher than the center hardness by 8 to 20, the hardness in JIS-C hardness of the intermediate layer is higher than the surface hardness of the core by not less than 5, the hardness in JIS-C hardness of the cover is lower than that of the intermediate layer by not less than 5, and the dimples occupy at least 62% of the ball surface. In the two golf balls, the hardness of the intermediate layer is higher than that of the cover, but the rigidity of the intermediate layer is increased together with the hardness, and thus shot feel is poor.

In Japanese Patent Kokai Publication No. 271249/2000, a multi-piece solid golf ball comprising a core consisting of an inner core and an outer core formed on the inner core, and one or more layers of cover covering the core is disclosed. The inner core has a diameter of 30 to 39.5 mm and a center hardness in JIS-C hardness of 55 to 70, and is formed from press molded rubber composition comprising polybutadiene, a co-crosslinking agent, an organic peroxide and a filler, and the JIS-C hardness at a distance of 15 mm from the center point of the inner core is higher than the center hardness by 5 to 20; the outer core has a thickness of 0.3 to 2.0 mm and a surface hardness in JIS-C hardness of 75 to 90, and is formed from press molded rubber composition comprising polybutadiene, a co-crosslinking agent, an organic peroxide and a filler, and the surface hardness of the outer core is higher than the center hardness of the inner core by 10 to 35; and the cover contains thermoplastic resin as a base resin, and the outmost cover layer has a thickness of 1.5 to 2.5 mm and a surface hardness in Shore D hardness of 64 to 72. In the golf ball, since the cover hardness is high, the shot feel is poor.

In Japanese Patent Kokai Publication No. 107327/2000, a three-piece solid golf ball comprising a core composed of a center having a diameter 27 to 37 mm and an intermediate layer covering the center, and a cover covering the core is disclosed. The specific gravity of the center (a) is smaller than that of the intermediate layer (b), a surface hardness in JIS-C hardness of the center (Y) is higher than a central point hardness in JIS-C hardness of the center (X) by not less than 8, a surface hardness of the core (Z) is not less than 80, a difference (p−q) between a deformation amount of the center (p) and that of the core (q), when applying from an initial load of 98 N to a final load of 1275 N, is not less than 5, and Shore D hardness of the cover is not more than 60. In the golf ball, since the thickness of the intermediate layer having relatively high hardness is large, the shot feel is poor performance and better durability.

In Japanese Patent Kokai Publication No. 317015/2000, a multi-piece solid golf ball comprising a core consisting of a center and an intermediate layer formed on the center, and a cover covering the core is disclosed. The intermediate layer (a) is formed from a rubber composition comprising a base rubber, a co-crosslinking agent, an organic peroxide and a filler,
(b) has a hardness in JIS-C hardness of 75 to 90, and the hardness of the intermediate layer is higher than a surface hardness in JIS-C hardness of the center by 1 to 12,
(c) has a thickness of 0.2 to 1.3 mm, and
(d) has a specific gravity of 1.20 to 1.60. In the golf ball, since it is required to use a large amount if the filler in order to increase the specific gravity of the intermediate layer, the rebound characteristics are degraded.

In the conventional solid golf balls, there has been no golf ball having excellent flight performance while maintaining good shot feel. Therefore, it is required to provide a golf ball having better shot feel and better flight performance.

OBJECTS OF THE INVENTION

A main object of the present invention is to provide a multi-piece solid golf ball having very good shot feel, while maintaining excellent rebound characteristics and excellent flight performance.

According to the present invention, the object described above has been accomplished by providing a multi-piece solid golf ball comprising a core consisting of a center and an intermediate layer, and a cover, and by adjusting hardness distribution between each layer in the golf ball and the contiguous layer; the thickness, hardness and flexural modulus of the intermediate layer; and the flexural modulus of the cover; to specified ranges, thereby providing a multi-piece solid golf ball having very good shot feel, while maintaining excellent rebound characteristics and excellent flight performance.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
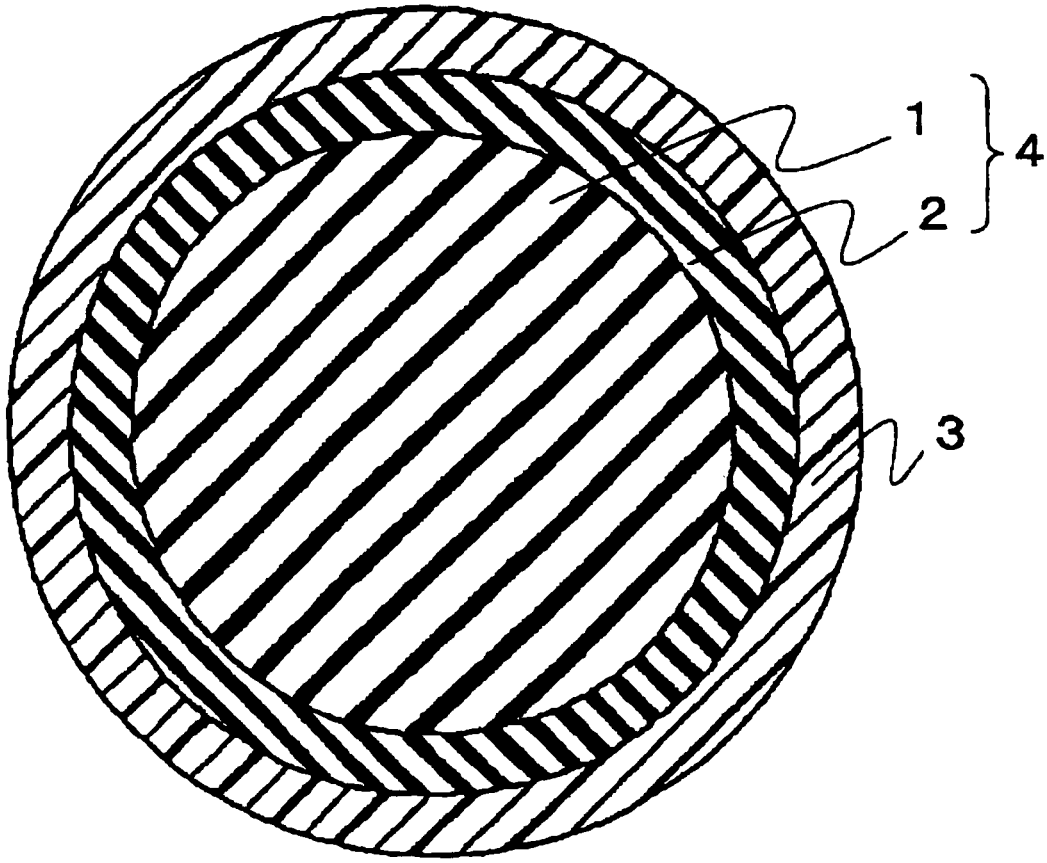
FIG. 1 is a schematic cross section illustrating one embodiment of the golf ball of the present invention.

The present invention provides a multi-piece solid golf ball comprising a core consisting of a center and an intermediate layer formed on the center, and at least one layer of a cover covering the core, wherein the intermediate layer has a thickness of 0.3 to 2.5 mm and a hardness in Shore D hardness of 50 to 75, the hardness of the intermediate layer is higher than a surface hardness in Shore D hardness of the center and a hardness in Shore D hardness of the outermost layer of the cover, and the flexural modulus of the intermediate layer is lower than that of the outermost layer of the cover.

In the golf ball comprising a center, an intermediate layer and a cover, when the hardness of the intermediate layer is higher than that of core surface and that of the cover, the hardness of the intermediate layer plays an important part, and the deformation of the resulting golf ball at the time of hitting is optimized. Therefore, the spin amount is decreased, and the flight performance is improved. However, in the conventional golf balls, when the hardness of the intermediate layer is high, the rigidity of the intermediate layer is also increased together with the hardness, and thus shot feel is poor. Therefore, in the golf ball of the present invention, it has been accomplished to improve flight performance and shot feel at the time of hitting by using the intermediate layer having high hardness and low rigidity.

The present inventors have studied materials for the intermediate layer in order to obtain the intermediate layer having high hardness and low rigidity as described above. As a result, it is apparent that the intermediate layer formed from rubber composition and the intermediate layer formed from resin composition, such as thermoplastic resin show different behavior of the hardness and rigidity. That is, when the intermediate layer having high hardness is formed from the resin composition as a material for the intermediate layer, the intermediate layer tends to have high rigidity. On the other hand, when the intermediate layer having high hardness is formed from the rubber composition, as compared with intermediate layer formed from the resin composition, the intermediate layer having low rigidity can be accomplished. Concretely, the intermediate layer having high hardness and low rigidity is accomplished by increasing the amount of the organic peroxide in the rubber composition too much as compared with the conventional rubber composition for golf balls as described later.

In order to put the present invention into a more suitable practical application, it is preferable that the intermediate layer have a specific gravity of smaller than 1.2 and a flexural modulus of not more than 200 MPa;

the outermost layer of the cover have a hardness in Shore D hardness of lower than 62, a flexural modulus of not less than 130 MPa and a thickness of 0.3 to 2.5 mm; and the intermediate layer be formed from rubber composition comprising polybutadiene, co-crosslinking agent, organic peroxide and filler as an essential component, the co-crosslinking agent be metal salt other than zinc salt of α,β-unsaturated carboxylic acid, and an amount of the organic peroxide in the rubber composition be not less than 4 parts by weight, based on 100 parts by weight of the polybutadiene.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 consisting of a center 1 and an intermediate layer 2 formed on the center, and at least one layer of a cover 3 covering the core. The cover may have single-layer structure or multi-layer structure, which has two or more layers. In FIG. 1, in order to explain the golf ball of the present invention simply, a golf ball having one layer of cover 3, that is, a three-piece solid golf ball will be used hereinafter for explanation. However, the golf ball of the present invention may be also applied for the golf ball having two or more layers of the cover.

The center 1 is obtained by press-molding a rubber composition under applied heat. The rubber composition essentially contains polybutadiene, a co-crosslinking agent, an organic peroxide and a filler. The polybutadiene used in the present invention may be one, which has been conventionally used for cores of solid golf balls. Preferred is so-called high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), or a blend of the metal salt of α,β-unsaturated carboxylic acid and acrylic ester or methacrylic ester and the like. The preferred co-crosslinking agent for the center 1 is zinc salt of α,β-unsaturated carboxylic acid, particularly zinc acrylate because it imparts high rebound characteristics to the resulting golf ball. The amount of the co-crosslinking agent is from 10 to 50 parts by weight, preferably from 10 to 45 parts by weight, more preferably from 15 to 45 parts by weight, based on 100 parts by weight of the polybutadiene. When the amount of the co-crosslinking agent is smaller than 10 parts by weight, the degree of crosslinking of the center is low, and the center is too soft, which degrades the rebound characteristics. On the other hand, when the amount of the co-crosslinking agent is larger than 50 parts by weight, the degree of crosslinking of the center is high, and the center is too hard, which degrades the shot feel.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.1 to 3.0 parts by weight, preferably from 0.3 to 2.8 parts by weight, more preferably from 0.5 to 2.5 parts by weight, based on 100 parts by weight of the polybutadiene.

When the amount of the organic peroxide is smaller than 0.1 parts by weight, the center is too soft, and the rebound characteristics the resulting golf ball are degraded, which reduces the flight distance. On the other hand, when the amount of the organic peroxide is larger than 3.0 parts by weight, it is difficult to impart a desired hardness to the center, and the shot feel of the resulting golf ball is poor.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is from 3 to 50 parts by weight, preferably from 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the center is small, and the rebound characteristics reduce too much.

The rubber compositions for the center of the golf ball of the present invention can contain other components, which have been conventionally used for preparing the core of solid golf balls, such as antioxidant or peptizing agent. If used, the amount of the antioxidant is preferably 0.1 to 1.0 parts by weight, and that of the peptizing agent is preferably 0.1 to 5.0 parts by weight, based on 100 parts by weight of the polybutadiene.

It is required for the intermediate layer 2 to be relatively hard and thin, which is different from the conventional golf ball, as described above. When the intermediate layer 2 is formed from thermoplastic resin, it has high hardness and high rigidity. Therefore, it is preferable for the intermediate layer 2 to be obtained by press-molding a rubber composition under applied heat the as the center 1. The rubber composition essentially contains polybutadiene, a co-crosslinking agent, an organic peroxide and a filler. The co-crosslinking agent for the intermediate layer 2 is preferably a metal salt other than zinc salt of α,β-unsaturated carboxylic acid, more preferably magnesium salt of α,β-unsaturated carboxylic acid, particularly magnesium methacrylate in view of crosslikability and productivity (releasability from a mold).

In order to obtain vulcanized rubber composition having higher hardness than the conventional golf ball, it is desired for the amount of the co-crosslinking agent in the intermediate layer 2 to be from 35 to 60 parts by weight, preferably from 40 to 55, more preferably 40 to 50 parts by weight, based on 100 parts by weight of the polybutadiene. In addition, it is desired for the amount of the organic peroxide in the intermediate layer 2 to be not less than 4 parts by weight, preferably from 4 to 9 parts by weight, more preferably from 5 to 8 parts by weight, based on 100 parts by weight of the polybutadiene.

Figure 2:
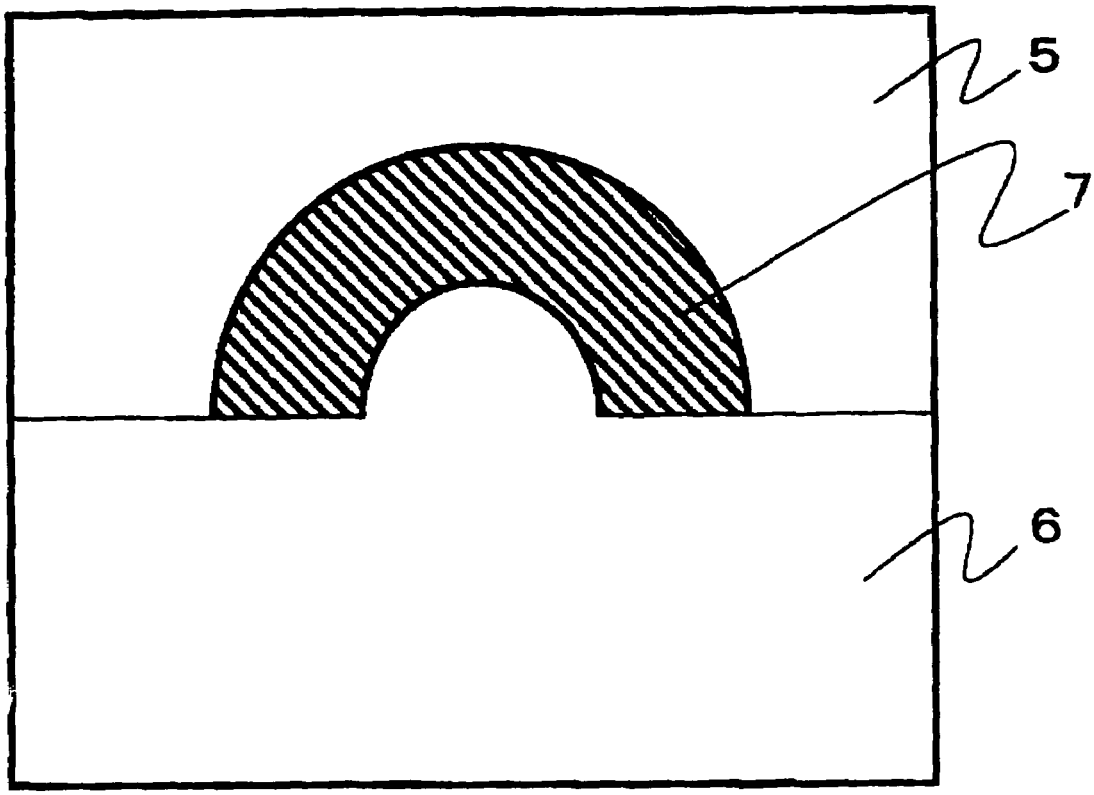
FIG. 2 is a schematic cross section illustrating one embodiment of a mold for molding an intermediate layer of the golf ball of the present invention.
Figure 3:
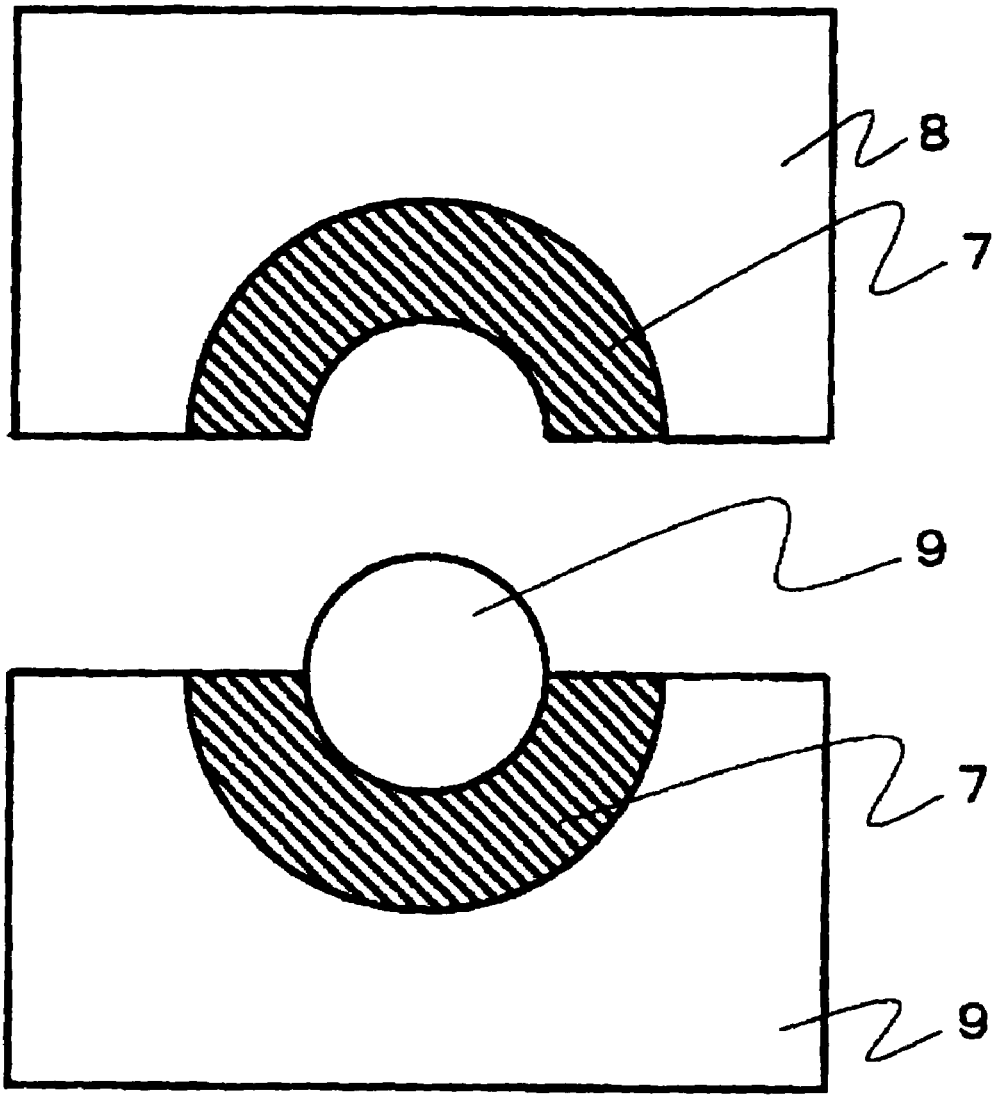
FIG. 3 is a schematic cross section illustrating one embodiment of a mold for molding a core of the golf ball of the present invention.

The process of producing the two-layer structured core used for the golf ball of the present invention will be explained with reference to FIG. 2 and FIG. 3. FIG. 2 is a schematic cross section illustrating one embodiment of a mold for molding an intermediate layer of the golf ball of the present invention. FIG. 3 is a schematic cross section illustrating one embodiment of a mold for molding a two-layer structured core of the golf ball of the present invention. The rubber composition for the center is molded by using an extruder to form a cylindrical unvulcanized center. The rubber composition for the intermediate layer is then vulcanized by press-molding under applied heat, for example, at 120 to 160° C. for 2 to 30 minutes using a mold having a semi-spherical cavity 5 and a male plug mold 6 having a semi-spherical convex having the same shape as the center as described in FIG. 2 to obtain a vulcanized semi-spherical half-shell 7 for the intermediate layer. The unvulcanized core 9 is covered with the two vulcanized semi-spherical half-shells 7 for the intermediate layer, and then vulcanized by integrally press-molding, for example, at 140 to 180° C. for 10 to 60 minutes in a mold 8 for molding a core, which is composed of an upper mold and a lower mold, as described in FIG. 3 to obtain the two-layer structured core. The two-layer structured core is composed of the center 1 and the intermediate layer 2 formed on the center. The process is one embodiment of a process of producing the core used for the golf ball of the present invention, and it is not limited thereto.

In the golf ball of the present invention, the center 1 has a diameter of 34.0 to 41.0 mm, preferably 34.5 to 40.5 mm, more preferably 35.0 to 40.0 mm. When the diameter of the center is smaller than 34.0 mm, the thickness of the intermediate layer or the cover having high rigidity is large, and the shot feel is poor. On the other hand, when the diameter of the center is larger than 41.0 mm, the technical effects accomplished by the presence of the intermediate layer and cover are not sufficiently obtained. The diameter of the center 1 is determined by cutting the resulting core having a two-layered structure, which is formed by integrally press-molding the center and the intermediate layer, into two equal parts and then measuring a diameter of the center 1 in section.

In the golf ball of the present invention, it is desired for the center 1 to have a central point hardness in Shore D hardness of 15 to 45, preferably 20 to 40. When the central point hardness of the center 1 is lower than 15, the center is too soft, and the rebound characteristics of the resulting golf ball are degraded. On the other hand, when the hardness is higher than 45, the center is too hard, and the shot feel of the resulting golf ball is hard and poor.

In the golf ball of the present invention, it is desired for the center 1 to have a surface hardness in Shore D hardness of 30 to 55, preferably 32 to 53. When the surface hardness of the center 1 is lower than 30, the center is too soft, and the rebound characteristics of the resulting golf ball are degraded. On the other hand, when the hardness is higher than 55, the center is too hard, and the shot feel is hard and poor.

A central point hardness of the center 1 as used herein means a hardness determined by cutting the two-layer structured core 4, which is formed by integrally press-molding the center and the intermediate layer, into two equal, and then measuring a hardness at the center point of the core in section. A surface hardness of the center 1 means a hardness determined by removing the intermediate layer from the two-layer structured core 4, which is formed by integrally press-molding the center 1 and the intermediate layer 2, to expose the center 1 after molding, and measuring a hardness at the surface of the exposed center 1.

In the golf ball of the present invention, it is required for the intermediate layer 2 to have a thickness of 0.3 to 2.5 mm, preferably 0.4 to 2.1 mm, more preferably 0.5 to 1.8 mm. When the thickness of the intermediate layer 2 is smaller than 0.3 mm, the technical effects accomplished by the presence of the intermediate layer are not sufficiently obtained. On the other hand, when the thickness is larger than 2.5 mm, the shot feel is poor.

In the golf ball of the present invention, it is required for the intermediate layer 2 to have a hardness in Shore D hardness of 50 to 75, preferably 55 to 72, more preferably 60 to 70. When the hardness of the intermediate layer is lower than 50, the intermediate layer is too soft, and the rebound characteristics of the resulting golf ball are degraded, which degrades the flight performance. On the other hand, when the hardness is higher than 75, the core is too hard, and the shot feel of the resulting golf ball is poor. A hardness of the intermediate layer 2 as used herein means a hardness determined by measuring a Shore D hardness using a sample of a stack of the three or more heat and press molded sheets having a thickness of about 2 mm from each intermediate layer composition, which had been stored at 23° C. for 2 weeks.

In the golf ball of the present invention, it is required that a hardness of the intermediate layer be higher than the surface hardness of the center, and the hardness difference thereof be preferably not less than 5, more preferably not less than 8. When the hardness of the intermediate layer is not more than the surface hardness of the center, the spin amount at the time of hitting is increased, and the flight performance is degraded.

In the golf ball of the present invention, it is desired for the intermediate layer 2 to have a flexural modulus of not more than 200 MPa, preferably 50 to 180 MPa, more preferably 70 to 160 MPa. When the flexural modulus of the intermediate layer 2 is higher than 200 MPa, the shot feel of the resulting golf ball is poor.

In the golf ball of the present invention, it is desired for the intermediate layer 2 to have a specific gravity of lower than 1.2, preferably lower than 1.18. When the specific gravity of the intermediate layer 2 is not less than 1.2, the amount of the filler is too large, and the weight ratio of the rubber component in the intermediate layer is small, which degrades the rebound characteristics.

In the golf ball of the present invention, it is desired for the core 4 to have a deformation amount when applying from an initial load of 98 N to a final load of 1275 N of 3.0 to 6.0 mm, preferably 3.2 to 5.0 mm, more preferably 3.4 to 4.8 mm. When the deformation amount is smaller than 3.0 mm, the core is too hard, and the resulting golf ball is difficult to deform, which reduces the flight performance and shot feel. On the other hand, when the deformation amount is larger than 6.0 mm, the deformation amount at the time of hitting is too large, and the rebound characteristics are degraded. In addition, the shot feel is heavy and poor.

The cover 3 is then formed on the core 4. In the golf ball of the present invention, the cover 3 preferably has single-layer structure, that is, it is a three-piece solid golf ball, in view of productivity, but the cover may have multi-layer structure, which has two or more layers.

In the golf ball of the present invention, it is required that the hardness of the intermediate layer be higher than a hardness in Shore D hardness of the outermost layer of the cover, and the hardness difference is preferably not more than 20, more preferably not more than 15, most preferably not more than 10. When the hardness of the intermediate layer is not more than that of the outermost layer of the cover, the hardness of the intermediate layer is relatively low, and the spin amount at the time of hitting is increased, which degrades the flight performance.

In the golf ball of the present invention, it is desired for the outermost layer of the cover 3 to have a hardness in Shore D hardness of lower than 62, preferably 45 to 62, more preferably 50 to 60. When the hardness of the outermost layer of the cover 3 is not less than 62, since the intermediate layer is also relatively hard, the portion having high hardness in the golf ball is large, and the shot feel is poor. The hardness of the cover 3 as used herein is determined by measuring a Shore D hardness (slab hardness), using a sample of a stack of the three or more heat and press molded sheets having a thickness of 2 mm from the composition for the cover, which had been stored at 23° C. for 2 weeks.

In the golf ball of the present invention, it is desired for the outermost layer of the cover 3 to have a thickness of 0.3 to 2.5 mm, preferably 0.5 to 2.1 mm, more preferably 0.8 to 1.8 mm. When the thickness of the outermost layer of the cover 3 is smaller than 0.3 mm, the durability is poor. On the other hand, when the thickness is larger than 2.5 mm, since the cover is formed from the materials having high rigidity, the shot feel is poor.

In the golf ball of the present invention, it is required that the flexural modulus of the intermediate layer 2 be lower than that of the outermost layer of the cover 3, and the flexural modulus difference be preferably 5 to 150 MPa, more preferably 10 to 120 MPa. When the flexural modulus of the intermediate layer 2 is not less than that of the outermost layer of the cover 3, the intermediate layer has high hardness and high rigidity, and the shot feel is poor.

In the golf ball of the present invention, it is desired for the outermost layer of the cover 3 to have a flexural modulus of not less than 130 MPa, preferably 150 to 300 MPa, more preferably 180 to 280 MPa. When the flexural modulus is lower than 130 MPa, the outermost layer of the cover is too soft, and the rebound characteristics of the resulting golf ball are not sufficiently obtained.

The cover 3 used for the golf ball of the present invention contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, and preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and like. Examples of the ionomer resins, which are commercially available from Exxon Chemical Co., include Iotek 7010, Iotek 8000 and like. These ionomer resins may be used alone or in combination.

As the materials suitably used in the cover 3 of the present invention, the above ionomer resin may be used alone, but the ionomer resin may be used in combination with at least one of thermoplastic elastomer, diene-based block copolymer and the like. Examples of the thermoplastic elastomers, which are commercially available, include polyamide-based thermoplastic elastomer, which is commercially available from Atofina Japan Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based thermoplastic elastomer, which is commercially available from BASF Polyurethane Elastomers Co., Ltd. under the trade name of "Elastollan" (such as "Elastollan ET880"); styrene-based thermoplastic elastomer, which is commercially available from Mitsubishi Chemical Co., Ltd. under the trade name of "Rabalon" (such as "Rabalon SR04); and the like.

The diene-based block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene-based block copolymers include an SBS (styrene-butadiene-styrene) block copolymer having polybutadiene-based block with epoxy groups or SIS (styrene-isoprene-styrene) block copolymer having polyisoprene block with epoxy groups and the like. Examples of the diene-based block copolymers, which are commercially available, include the diene-based block copolymers, which are commercially available from Daicel Chemical Industries, Ltd. under the trade name of "Epofriend" (such as "Epofriend A1010"), the diene-based block copolymers, which are commercially available from Kuraray Co., Ltd. under the trade name of "Septon" (such as "Septon HG-252" and the like) and the like.

The amount of the thermoplastic elastomer or diene-based block copolymer is 1 to 60 parts by weight, preferably 1 to 35 parts by weight, based on 100 parts by weight of the base resin for the cover. When the amount is smaller than 1 part by weight, the technical effects of absorbing the impact force at the time of hitting accomplishing by using them are not sufficiently obtained. On the other hand, when the amount is larger than 60 parts by weight, the cover is too soft and the rebound characteristics are degraded, or the compatibility with the ionomer resin is degraded and the durability is degraded.

The composition for the cover used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering with the cover 3 is not specifically limited, but may be a conventional method. For example, there can be used a method comprising molding the cover composition into a semi-spherical half-shell in advance, covering the core, which is covered with the intermediate layer, with the two half-shells, followed by pressure molding at 130 to 170° C. for 1 to 5 minutes, or a method comprising injection molding the cover composition directly on the core to cover it. At the time of molding the cover, many depressions called "dimples" may be optionally formed on the surface of the golf ball. Furthermore, paint finishing or marking with a stamp may be optionally provided after the cover molded for commercial purposes.

In the golf ball of the present invention, it is desired to have a deformation amount when applying from an initial load of 98 N to a final load of 1275 N of 2.8 to 4.5 mm, preferably 3.0 to 4.3 mm, more preferably 3.1 to 4.0 mm. When the deformation amount is smaller than 2.8 mm, the shot feel is hard and poor, even if the deformation amount of the core is adjusted to a proper range. On the other hand, when the deformation amount is larger than 4.5 mm, the golf ball is too soft, and the shot feel is heavy and poor.

EXAMPLES

The following Examples and Comparative Examples further illustrate the present invention in detail but are not to be construed to limit the scope of the present invention.

(i) Production of Unvulcanized Molded Article for the Center

The rubber compositions for the center shown in Table 1 were mixed, and then extruded to obtain cylindrical unvulcanized plugs.

TABLE 1

| | (parts by weight) | | | |
|---|---|---|---|---|
| Center composition | I | II | III | IV |
| BR-11 *1 | 100 | 100 | 100 | 100 |
| Zinc acrylate | 25 | 27 | 21 | 23 |
| Zinc oxide | 5 | 5 | 5 | 5 |
| Dicumyl peroxide | 0.8 | 0.8 | 0.8 | 0.8 |
| Diphenyl disulfide | 0.5 | 0.5 | 0.5 | 0.5 |
| Barium sulfate (*) | Proper amount | Proper amount | Proper amount | Proper amount |

*1: High-cis Polybutadiene rubber, commercially available from JSR Co., Ltd. under the trade name of "BR-11" (Content of 1,4-cis-polybutadiene: 96%)
(*) The amount of barium sulfate was adjusted to a proper amount such that the weight of the resulting golf ball was 45.4 g.

(ii) Production of Vulcanized Semi-Spherical Half-Shell for the Intermediate Layer The rubber compositions for the intermediate layer shown in Table 2 were mixed, and then vulcanized by press-molding at the vulcanization condition shown in the same Tables in the mold (5, 6) as described in FIG. 2 to obtain vulcanized semi-spherical half-shells 7 for the intermediate layer. Shore D hardness was measured, using a sample of a stack of the three or more heat and press molded sheets having a thickness of about 2 mm from each intermediate layer composition, which had been stored at 23° C. for 2 weeks, with a Shore D hardness meter according to ASTM D 2240-68. The results are shown in Tables 2, 4 and 5 as the intermediate layer hardness (b).

TABLE 2

| Intermediate layer composition | (parts by weight) A | B | C | D |
|---|---|---|---|---|
| BR-11 *1 | 100 | 100 | — | — |
| Magnesium methacrylate | 40 | 30 | — | — |
| Magnesium oxide | 17 | 18 | — | — |
| Dicumyl peroxide | 5 | 2 | — | — |
| Hi-milan 1555 *2 | — | — | — | 20 |
| Hi-milan 1557 *3 | — | — | 40 | 20 |
| Hi-milan 1605 *4 | — | — | 60 | — |
| Hi-milan 1855 *5 | — | — | — | 60 |
| Barium sulfate | — | — | 12.5 | 12.5 |
| Hardness (Shore D) | 62 | 35 | 62 | 55 |
| Flexural modulus (MPa) | 155 | 59 | 250 | 175 |
| Specific gravity | 1.05 | 1.05 | 1.05 | 1.05 |

*1: High-cis Polybutadiene rubber, commercially available from JSR Co., Ltd. under the trade name of "BR-11" (Content of 1,4-cis-polybutadiene: 96%)
*2: Hi-milan 1555 (trade name), ethylene-methacrylic acid copolymer ionomer resin obtained by neutralizing with sodium ion, manufactured by Du Pont-Mitsui Polychemicals Co., Ltd.
*3: Hi-milan 1557 (trade name), ethylene-methacrylic acid copolymer ionomer resin obtained by nuetralizing with zinc ion, manufactured by Du Pont-Mitsui Polychemicals Co., Ltd.
*4: Hi-milan 1605 (trade name), ethylene-methacrylic acid copolymer ionomer resin obtained by neutralizing with sodium ion, manufactured by Du Pont-Mitsui Polychemicals Co., Ltd.
*5: Hi-milan 1855 (trade name), ethylene-methacrylic acid-acrylic acid ester terpolymer ionomer resin obtained by nuetralizing with zinc ion, manufactured by Du Pont-Mitsui Polychemicals Co., Ltd.

(iii) Production of Two-Layer Structured Core

The cylindrical unvulcanized plugs 9 produced in the step (i) were covered with the two vulcanized semi-spherical half-shells 7 for the intermediate layer produced in the step (ii), and then vulcanized by press-molding at the vulcanization condition shown in Table 4 (Examples) and Table 5 (Comparative Examples) in the mold 8 as described in FIG. 3 to obtain two-layer structured cores 4. The diameter, central point hardness and surface hardness (a) of the center, the thickness, flexural modulus (d) and specific gravity of the intermediate layer, the deformation amount of the core were measured, the results are shown in the same Tables. The hardness difference (b−a) was determined by calculating from the hardness values described above, and the result is shown in the same Tables.

(iv) Preparation of Cover Compositions

The formulation materials showed in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder. Shore D hardness was measured, using a sample of a stack of the three or more heat and press molded sheets having a thickness of about 2 mm from each intermediate layer composition, which had been stored at 23° C. for 2 weeks, with a Shore D hardness meter according to ASTM D 2240. The results are shown in Tables 3 to 5 as the cover hardness (c). The flexural modulus and specific gravity of the heat and press molded sheet were measured, and the results are shown in the same Tables as the flexural modulus (e) and specific gravity of the cover. The hardness difference (b−c) and flexural modulus difference (e−d) were determined by calculating from the hardness values and flexural modulus values described above, respectively. The results are shown in the same Tables.

TABLE 3

| Cover composition | (parts by weight) X | Y |
|---|---|---|
| Hi-milan 1605 *4 | 20 | 50 |
| Hi-milan 1706 *6 | 20 | 50 |
| Hi-milan 1855 *5 | 60 | — |
| Titanium oxide | 2 | 2 |
| Hardness (Shore D) | 58 | 64 |
| Flexural modulus (MPa) | 198 | 280 |
| Specific gravity | 0.98 | 0.98 |

*4: Hi-milan 1605 (trade name), ethylene-methacrylic acid copolymer ionomer resin obtained by neutralizing with sodium ion, manufactured by Du Pont-Mitsui Polychemicals Co., Ltd.
*5: Hi-milan 1855 (trade name), ethylene-methacrylic acid-acrylic acid ester terpolymer ionomer resin obtained by neutralizing with zinc ion, manufactured by Du Pont-Mitsui Polychemicals Co., Ltd.
*6: Hi-milan 1706 (trade name), ethylene-methacrylic acid copolymer ionomer resin obtained by neutralizing with zinc ion, manufactured by Du Pont-Mitsui Polychemicals Co., Ltd.

Examples 1 to 3 and Comparative Examples 1 to 4

The cover compositions were covered on the resulting two-layer structured core 4 by directly injection molding using a mold having dimples to form a cover having a thickness The cover composition was covered on the resulting two-layer structured core 4 produced in the step (iii) by directly injection molding to form the cover layer 3 having a thickness shown in Table 4 (Examples) and Table 5 (Comparative Examples). Then, paint was applied on the surface to produce golf ball having a diameter of 42.7 mm. With respect to the resulting golf balls, the deformation amount, coefficient of restitution, flight distance and shot feel were measured or evaluated. The results are shown in the same Tables. The test methods are as follows.

Test Methods (1) Hardness (i) Hardness of Center

The central point hardness of the center is determined by cutting the resulting core having a two-layered structure, which is formed by integrally press-molding the center and the intermediate layer, into two equal parts and then measuring a Shore D hardness at its central point in section. The surface hardness of the center is determined by measuring a Shore D hardness at the surface of the center, after removing the intermediate layer from the core having a two-layered structure to expose the center.

(ii) Hardness of Intermediate Layer and Cover a) When the intermediate layer is formed from rubber composition, the hardness of the intermediate layer is determined by measuring a Shore D hardness at the surface of the core having a two-layered structure, which is formed by integrally press-molding the center and the intermediate layer.

(ii) Hardness of Intermediate Layer and Cover

The hardness of the intermediate layer and cover were determined by measuring a hardness (slab hardness), using a sample of a stack of the three or more heat and press molded sheets having a thickness of about 2 mm from the intermediate layer composition and cover composition, which had been stored at 23° C. for 2 weeks.

a) When the intermediate layer is formed from rubber composition, the heat and press molded sheet was prepared by press-molding the rubber composition in a mold at the same vulcanization condition as the core is molded.

b) When the intermediate layer and cover are formed from thermoplastic resin, the heat and press molded sheet was prepared by injection molding the composition for the intermediate layer or cover.

The Shore D hardness was measured by using an automatic rubber hardness tester (type LA1), which is commercially available from Kobunshi Keiki Co., Ltd., with a Shore D hardness meter according to ASTM D 2240-68.

(2) Flexural Modulus

The flexural modulus was determined according to JIS K 7106, using a sample of the same heat and press molded sheet as used for measuring the hardness, which had been stored at 23° C. for 2 weeks.

(3) Deformation Amount of Core and Golf Ball

The deformation amount of the core of golf ball was determined by measuring a deformation amount when applying from an initial load of 98 N to a final load of 1275 N on the core or golf ball.

(4) Coefficient of Resilience

A cylindrical aluminum projectile having a weight of 200 g was struck at a speed of 40 m/sec against a golf ball, and the velocity of the projectile and golf ball after the strike was measured. The coefficient of resilience of the golf ball was calculated from the velocity and the weight of both the projectile and the golf ball before and after the strike. The measurement was conducted by using 12 golf balls for each sample (n=12), with the mean value being taken as the coefficient of resilience of each ball and expressed as an index, with the value of the index in Comparative Example 1 being taken as 1. A higher index corresponded to a higher rebound characteristic, and thus a good result.

(5) Flight Distance

After a No.1 wood club (a driver, W#1; "XXIO" loft angle=11 degrees, R shaft, manufactured by Sumitomo Rubber Industries, Ltd.) having a metal head was mounted to a swing robot manufactured by True Temper Co. and the golf ball was hit at a head speed of 40 m/sec, the flight distance was measured. As the flight distance, carry that is a distance to the drop point of the hit golf ball was measured. The measurement was conducted by using 12 golf balls for each sample (n=12), and the average is shown as the result of the golf ball.

(6) Shot Feel

The shot feel of the golf ball is evaluated by 10 golfers according to a practical hitting test using a No. 1 wood club (W#1, a driver). The evaluation criteria are as follows.

Evaluation Criteria oo: Not less than 8 golfers out of 10 golfers felt that the golf ball has good shot feel such that the impact force at the time of hitting is small and the rebound characteristics are good.

o: Six to 7 golfers out of 10 golfers felt that the golf ball has good shot feel such that the impact force at the time of hitting is small and the rebound characteristics are good.

Δ: Four to 5 golfers out of 10 golfers felt that the golf ball has good shot feel such that the impact force at the time of hitting is small and the rebound characteristics are good.

x: Not more than 3 golfers out of 10 golfers felt that the golf ball has good shot feel such that the impact force at the time of hitting is small and the rebound characteristics are good.

(Test Results)

TABLE 4

| | | Example No. | | |
|---|---|---|---|---|
| | | 1 | 2 | 3 |
| (Center) | | | | |
| Composition | | I | II | IV |
| Diameter (mm) | | 36.2 | 36.2 | 34.4 |
| Hardness | Center point | 32 | 30 | 29 |
| (Shore D) | Surface (a) | 44 | 46 | 41 |
| (Intermediate layer) | | | | |
| Composition | | A | A | A |
| Thickness (mm) | | 1.5 | 1.5 | 2.4 |
| Hardness (b) (Shore D) | | 62 | 62 | 62 |
| Hardness difference (b − a) | | 18 | 16 | 21 |
| Flexural modulus (d) (MPa) | | 155 | 155 | 155 |
| Specific gravity | | 1.05 | 1.05 | 1.05 |
| (Core) | | | | |
| Vulcanization | Temp. (° C.) | 155 | 160 | 155 |
| condition | Time (min) | 30 | 30 | 30 |
| Deformation amount (mm) | | 4.0 | 3.7 | 4.3 |
| (Cover) | | | | |
| Composition | | X | X | X |
| Thickness (mm) | | 1.8 | 1.8 | 1.8 |
| Hardness (c) (Shore D) | | 58 | 58 | 58 |
| Hardness difference (b − c) | | 4 | 4 | 4 |
| Flexural modulus (e) (MPa) | | 198 | 198 | 198 |
| Difference (e − d) (MPa) | | 43 | 43 | 43 |
| (Golf ball) | | | | |
| Deformation amount (mm) | | 3.1 | 3.0 | 3.5 |
| Coefficient of restitution | | 1.01 | 1.03 | 1 |
| Flight distance (m) | | 192 | 193 | 191 |
| Shot feel | | oo | oo | oo |

TABLE 5

| | | Comparative Example No. | | | |
|---|---|---|---|---|---|
| | | 1 | 2 | 3 | 4 |
| (Center) | | | | | |
| Composition | | I | I | I | III |
| Diameter (mm) | | 36.2 | 36.2 | 36.2 | 33.6 |
| Hardness | Center point | 32 | 32 | 32 | 28 |
| (Shore D) | Surface (a) | 44 | 44 | 44 | 40 |
| (Intermediate layer) | | | | | |
| Composition | | D | B | C | A |
| Thickness (mm) | | 1.5 | 1.5 | 1.5 | 2.8 |
| Hardness (b) (Shore D) | | 55 | 35 | 62 | 62 |
| Hardness difference (b − a) | | 11 | −9 | 18 | 22 |
| Flexural modulus (d) (MPa) | | 175 | 59 | 250 | 155 |
| Specific gravity | | 1.05 | 1.05 | 1.05 | 1.05 |
| (Core) | | | | | |
| Vulcanization | Temp. (° C.) | 155 | 155 | 155 | 155 |
| condition | Time (min) | 30 | 30 | 30 | 30 |
| Deformation amount (mm) | | 4.1 | 4.2 | 3.9 | 3.9 |

TABLE 5-continued

| | Comparative Example No. | | | |
|---|---|---|---|---|
| | 1 | 2 | 3 | 4 |
| (Cover) | | | | |
| Composition | X | X | X | Y |
| Thickness (mm) | 1.8 | 1.8 | 1.8 | 1.8 |
| Hardness (c) (Shore D) | 58 | 58 | 58 | 64 |
| Hardness difference (b − c) | −3 | −23 | 4 | −2 |
| Flexural modulus (e) (MPa) | 198 | 198 | 198 | 280 |
| Difference (e − d) (MPa) | 23 | 139 | −52 | 125 |
| (Golf ball) | | | | |
| Deformation amount (mm) | 3.3 | 3.5 | 3.2 | 2.8 |
| Coefficient of restitution | 1 | 0.98 | 1.02 | 1.03 |
| Flight distance (m) | 190 | 188 | 192 | 193.5 |
| Shot feel | ○○ | ○ | Δ | x |

As is apparent from Tables 4 to 5, the golf balls of Examples 1 to 3 of the present invention, when compared with the golf balls of Comparative Examples 1 to 4, have very soft and good shot feel, excellent rebound characteristics and excellent flight performance.

On the other hand, in the golf ball of Comparative Example 1, since the hardness of the intermediate layer is not more than that of the cover, the spin amount at the time of hitting is increased, and the hit golf ball creates blown-up trajectory, which reduces the flight distance. In the golf ball of Comparative Example 2, since the hardness of the intermediate layer is low, the coefficient of restitution is small, which reduces the flight distance. In addition, since the hardness of the intermediate layer is not more than the surface hardness of the center, the spin amount at the time of hitting is increased, and the hit golf ball creates blown-up trajectory, which reduces the flight distance.

In the golf ball of Comparative Example 3, since the flexural modulus of the intermediate layer is not less than that of the cover, the shot feel is poor. In the golf ball of Comparative Example 4, since the thickness of the intermediate layer is large and the hardness of the cover is high, the shot feel is poor.

What is claimed is:

1. A multi-piece solid golf ball comprising a core consisting of a center and an intermediate layer formed on the center, and at least one layer of a cover covering the core, wherein the center has a central point hardness in Shore D hardness of 20 to 40 and a surface hardness in Shore D hardness of 32 to 53, the intermediate layer has a thickness of 0.3 to 2.5 mm and a hardness in Shore D hardness of 50 to 75 and a flexural modulus of 70 to 160 MPa, the outermost layer of the cover has a flexural modulus of 180 to 280 MPa, the golf ball has a deformation amount when applying from an initial load of 98 N to a final load of 1275 N of 3.0 to 4.3 mm, the hardness of the intermediate layer is higher than a surface hardness in Shore D hardness of the center and a hardness in Shore D hardness of the outermost layer of the cover, and the flexural modulus of the intermediate layer is lower than that of the outermost layer of the cover, and the intermediate layer is formed from a rubber composition comprising polybutadiene, co-crosslinking agent, organic peroxide and filler as essential components, and the co-crosslinking agent is a metal salt other than a zinc salt of a,β-unsaturated carboxylic acid.

2. The multi-piece solid golf ball according to claim 1, wherein the intermediate layer has a specific gravity of smaller than 1.2.

3. The multi-piece solid golf ball according to claim 1, wherein the outermost layer of the cover has a hardness in Shore D hardness of lower than 62, and a thickness of 0.3 to 2.5 mm.

4. The multi-piece solid golf ball according to claim 1, wherein the intermediate layer has a thickness of 0.4 to 2.1 mm and a hardness in Shore D hardness of 55 to 72.

5. The multi-piece solid golf ball according to claim 1, wherein the intermediate layer has a thickness of 0.5 to 1.8 mm and a hardness in Shore D hardness of 60 to 70.

6. The multi-piece solid golf ball according to claim 2, wherein the intermediate layer has a specific gravity of lower than 1.18.

7. The multi-piece solid golf ball according to claim 1, wherein the hardness of the intermediate layer is higher than the hardness of the outermost layer of the cover in Shore D hardness of not more than 20.

8. The multi-piece solid golf ball according to claim 1, wherein the hardness of the intermediate layer is higher than the hardness of the outermost layer of the cover in Shore D hardness of not more than 15.

9. The multi-piece solid golf ball according to claim 1, wherein the hardness of the intermediate layer is higher than the hardness of the outermost layer of the cover in Shore D hardness of not more than 10.

10. The multi-piece solid golf ball according to claim 1, wherein the outermost layer of the cover has a hardness in Shore D hardness of 45 to 62.

11. The multi-piece solid golf ball according to claim 1, wherein the flexural modulus of the intermediate layer is lower than that of the outermost layer of the cover by a difference of 5 to 150 MPa.

12. The multi-piece solid golf ball according to claim 1, wherein the flexural modulus of the intermediate layer is lower than that of the outermost layer of the cover by a difference of 10 to 120 MPa.

13. The multi-piece solid golf ball according to claim 1, wherein the surface hardness of the center is higher than the central point hardness of the center by 12 to 16.

* * * * *